US005827053A

United States Patent [19]

Costa

[11] Patent Number: 5,827,053

[45] Date of Patent: Oct. 27, 1998

[54] POSITIVE FLOW PURGE SYSTEM FOR MICROFLAME TORCH

[76] Inventor: Larry J. Costa, 54201 Ash Rd., Osceola, Ind. 46561

[21] Appl. No.: 900,980

[22] Filed: Jul. 25, 1997

[51] Int. Cl.[6] ..... F23D 11/38

[52] U.S. Cl. ..... 431/121; 431/346; 48/192

[58] Field of Search ..... 431/346, 121; 48/192

[56] References Cited

U.S. PATENT DOCUMENTS

| | | | |
|---|---|---|---|
| 3,957,618 | 5/1976 | Spirig | 204/270 |
| 4,113,601 | 9/1978 | Spirig | 204/230 |
| 4,206,029 | 6/1980 | Spirig | 204/228 |
| 4,336,122 | 6/1982 | Spirig | 204/222 |
| 4,647,201 | 3/1987 | McCaffrey | 431/346 |
| 4,923,394 | 5/1990 | Fumino | 431/346 |
| 5,169,053 | 12/1992 | Rochat | 445/45 |

OTHER PUBLICATIONS

Brocure: "The Spirflame® ", Undated, offered by Spirig, 18 pages.

*Primary Examiner*—Carroll B. Dority
*Attorney, Agent, or Firm*—Zarley, McKee, Thomte Voorhees & Sease; Dennis L. Thomte

[57] ABSTRACT

A positive flow purge system for a microflame torch including a source of combustible gas, a source of non-combustible gas and a gas valve having first and second gas inlets and a gas outlet. A first gas line connects the source of combustible gas to the first gas inlet and a second gas line connects the source of non-combustible gas to the second gas inlet. A third gas line connects the gas outlet of the valve to a microflame nozzle tip. A flashback arrestor is imposed in the first gas line between the source of the combustible gas and the first gas inlet. The gas valve permits the non-combustible gas to flow to the nozzle tip so that the flame at the nozzle tip will be extinguished when the gas valve is moved from its on position to its off position.

3 Claims, 2 Drawing Sheets

POSITIVE FLOW PURGE SYSTEM FOR MICROFLAME TORCH

BACKGROUND OF THE INVENTION

1. Field of the Invention

This invention relates to a positive flow purge system for a microflame torch and more particularly to a positive flow purge system for a microflame torch to prevent flashback of combustible gas and oxygen.

2. Description of the Prior Art

Microflame soldering is well-known in the art and the requirements and technology therefore are disclosed in U.S. Pat. No. 5,169,053. In addition, see also U.S. Pat. Nos. 3,957,618; 4,113,601; 4,206,029; and 4,336,122. Generally speaking, many microflame systems such as illustrated in FIG. 1 include a generator which generates combustible gas which is delivered to a booster system for lowering the flame temperature, with the booster being connected to one or more torches. Most microflame soldering systems utilize a combustible gas mixture of hydrogen and oxygen. The mixture of hydrogen and oxygen will burn within the supply hoses if ignited. Normally, the flame at the nozzle tip does not ignite the combustible gas within the supply hoses because the combustible gas pressure is maintained by its supply, thereby preventing the flame from travelling back from the flame nozzle tip into the gas supply hose. Flashback is initiated from the flame nozzle tip when the external flame travels back into the gas supply hose when the gas pressure lowers as it exits the open flame nozzle tip.

SUMMARY OF THE INVENTION

A source of combustible gas and a source of non-combustible gas are in communication with a gas valve having first and second gas inlets and a gas outlet. The gas valve is movable between "on" and "off" positions. A first gas line connects the source of combustible gas to the first gas inlet and a second gas line connects the source of non-combustible gas to the second gas inlet. A third gas line connects the gas outlet to the microflame nozzle tip. A flashback arrestor is imposed in the first gas line between the source of combustible gas and the first gas inlet. The gas valve permits the non-combustible gas to flow continuously to the nozzle tip so that the flame at the nozzle tip will be extinguished when the gas valve is moved from its "on" position to its "off" position. Preferably, the gas valve comprises a two-position, three-port, electrical solenoid gas valve. Additionally, the source of non-combustible gas preferably comprises a source of low pressure compressed air.

It is therefore a principal object of the invention to provide a positive flow purge system for a microflame torch which eliminates flashbacks within the gas supply hoses.

Yet another object of the invention is to provide a positive flow purge system for microflame torches which improves the safety of microflame technology in its commercial application by reducing the risk of flashbacks.

Still another object of the invention is to provide a system of the type described which prevents the combustible gasses within the supply hoses from being ignited when the torch is deactivated.

These and other objects will be apparent to those skilled in the art.

DESCRIPTION OF THE PREFERRED EMBODIMENT

Figure 1:
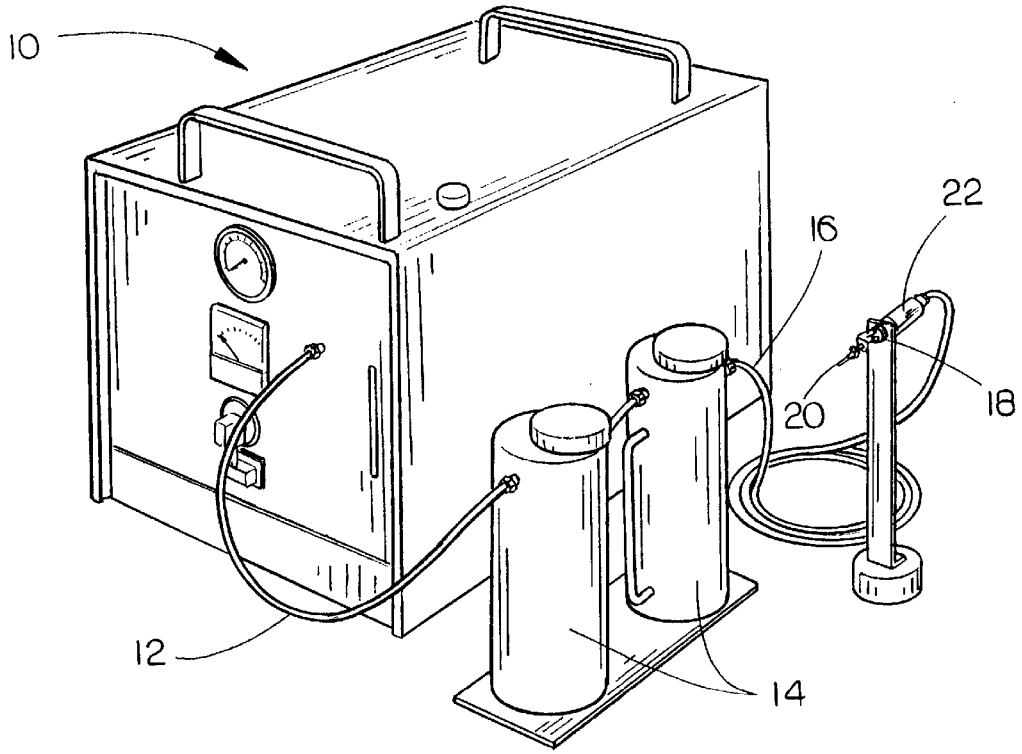
FIG. 1 (PRIOR ART)
FIG. 1 is a perspective view of a prior art microflame system.
Figure 2:
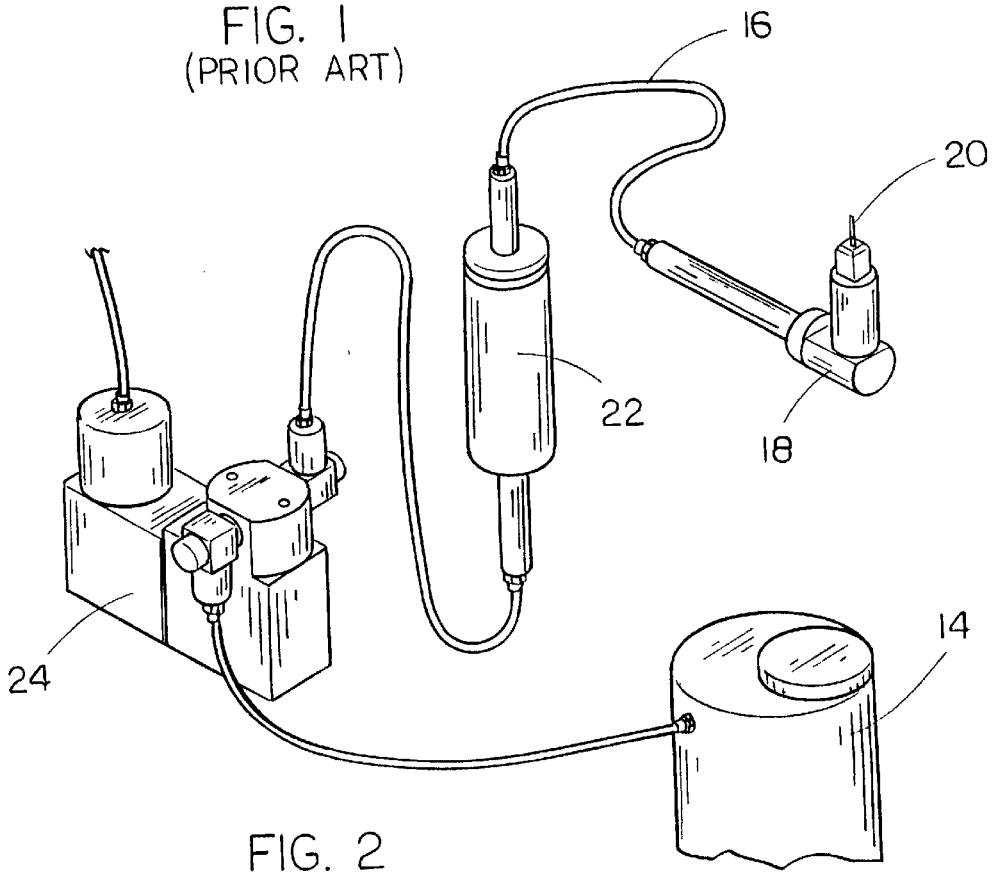
FIG. 2 (PRIOR ART)
FIG. 2 is a perspective view of a prior art flashback system for use with the prior art device of FIG. 1.

FIGS. 1 and 2 illustrate prior art devices. In FIG. 1, the numeral 10 refers to a combustible gas generator having a combustible gas supply line 12 extending therefrom to one or more canisters 14 having a fuel supply line 16 extending therefrom to a torch handle 18 having a flame nozzle tip 20. Normally, a flashback arrestor 22 is provided in the supply line 16 which extends from gas valve 24 which is in communication with the canisters 14. Flashback is a problem with the configuration illustrated in FIG. 2 when the electrical gas valve 24 is de-energized to shut off the gas supply and extinguish the flame. This causes the loss of gas pressure as it exits the open flame nozzle tip 20. The flashback is initiated from the flame nozzle tip 20 when the external flame travels back into the gas supply hose 16. The flashback is arrested by the flashback protection device 22 to prevent ignition of the combustible gas supply. However, the noise of the explosion, similar to a small caliber gunshot, and the reassembly of the gas supply hose 16 is an annoyance. In addition, the flashback protection device 22 must be periodically replaced, as the flashback explosions can damage the same. A further problem with the configuration of FIG. 2 is that the electrical gas valve 24 is located between the combustible gas supply 14 and the flashback protection device 22 inasmuch as the electrical gas valve 24 is a potential ignition source of the combustible gas supply and there is nothing to prevent the flashback to reach the combustible gas supply.

Figure 3:
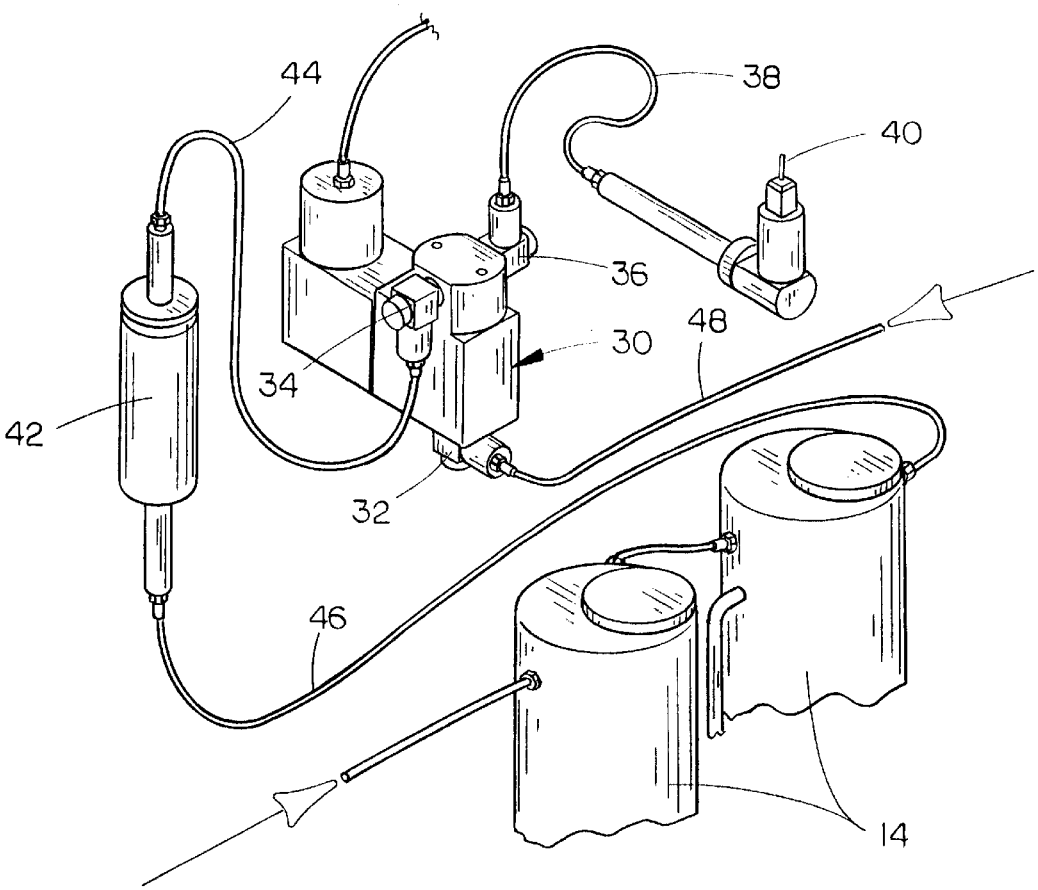
FIG. 3 is a perspective view illustrating the positive flow purge system of this invention.
Figure 4A:
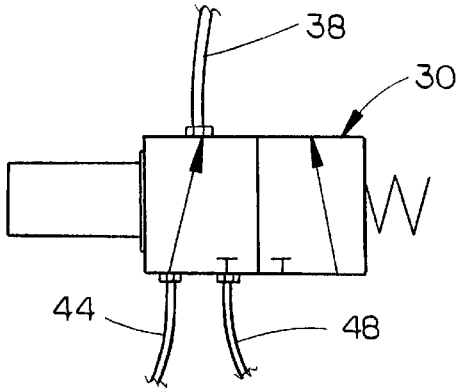
FIG. 4A is a schematic illustrating the gas valve in its "on" position.
Figure 4B:
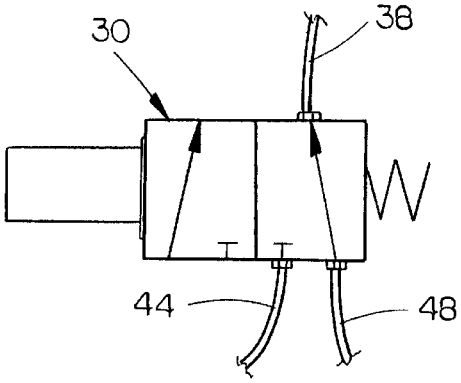
FIG. 4B is a schematic similar to FIG. 4A except that the gas valve has been moved to its "off" position.

The positive flow purge system of this invention is illustrated in FIGS. 3, 4A and 4B. In FIG. 3, the numeral 30 refers to a two-position, three-port, electrical gas control valve having gas inlets 32 and 34 and gas outlet 36. Supply line 38 extends from gas outlet 36 to the flame nozzle tip 40. The numeral 42 refers to a conventional flashback protection device or arrestor, such as illustrated in FIG. 2, but which is positioned at the upstream side of the gas control valve 30 and which is connected to the gas inlet 34 by supply hose 44. The inlet end of flashback protection device 42 is connected to the canisters 14 which are connected in series and which are connected to the combustible gas generator by hose 46. Gas inlet 32 is connected to a source of low pressure, non-combustible gas such as compressed air by means of supply hose 48.

FIGS. 4A and 4B schematically represent the "on" and "off" positions of the valve 30, respectively. When the valve 38 is in the "on" position, as illustrated in FIG. 4A, the combustible gas is supplied to the flame nozzle tip 40 by means of the hose or supply line 38. When in the position of FIG. 4A, the non-combustible gas is routed to the flame tip by the open valve port which permits the non-combustible gas to flow continuously to the flame nozzle tip 40 which is connected to the exit port of the valve, thereby causing the flame to be extinguished when the gas valve is de-energized so that flashback into the supply hose 38 is prevented, due to the flow of non-combustible gas through the flame nozzle tip 40. The positive flow purge system of this invention eliminates flashbacks within the gas supply hoses and its potential ignition of the combustible gas supply by maintaining the pressure within the gas supply hoses with a non-combustible gas, thereby preventing flashback within the gas supply hoses when the gas valve is de-energized to extinguish the flame. The positive flow purge system of this invention improves the safety of microflame technology and its commercial application by reducing the risk of flashbacks.

Thus it can be seen that the invention accomplishes at least all of its stated objectives.

I claim:

1. In combination:

a source of combustible gas;

a source of non-combustible gas;

a gas valve having first and second gas inlets and a gas outlet;

said gas valve being movable between "on" and "off" positions;

a first gas line connecting said source of combustible gas to said first gas inlet;

a second gas line connecting said source of non-combustible gas to said second gas inlet;

a micro-flame nozzle tip;

a third gas line connecting said gas outlet to said nozzle tip;

and a flash back arrestor imposed in said first gas line between said source of combustible gas and said first gas inlet;

said gas valve permitting the non-combustible gas to flow to the nozzle tip so that the flame at said nozzle tip will be extinguished when said gas valve is moved from its said "on" position to its said "off" position.

2. The combination of claim 1 wherein said gas valve comprises a two position, three port, electrical solenoid gas valve.

3. The combination of claim 1 wherein said source of non-combustible gas comprises a source of low pressure compressed air.

* * * * *